US010443013B2

(12) United States Patent
Ugamura et al.

(10) Patent No.: US 10,443,013 B2
(45) Date of Patent: Oct. 15, 2019

(54) VISCOSITY INDEX IMPROVER, METHOD FOR PRODUCING THE SAME AND LUBRICATING OIL COMPOSITION

(71) Applicant: NIPPON SHOKUBAI CO., LTD., Osaka (JP)

(72) Inventors: Tadayoshi Ugamura, Osaka (JP); Kazunari Yasumura, Osaka (JP); Keiko Izumi, Osaka (JP)

(73) Assignee: NIPPON SHOKUBAI CO., LTD., Osaka (JP)

( * ) Notice: Subject to any disclaimer, the term of this patent is extended or adjusted under 35 U.S.C. 154(b) by 32 days.

(21) Appl. No.: 15/503,032

(22) PCT Filed: Sep. 15, 2015

(86) PCT No.: PCT/JP2015/076181
§ 371 (c)(1),
(2) Date: Feb. 10, 2017

(87) PCT Pub. No.: WO2016/043195
PCT Pub. Date: Mar. 24, 2016

(65) Prior Publication Data

US 2017/0233675 A1 Aug. 17, 2017

(30) Foreign Application Priority Data

Sep. 17, 2014 (JP) ..... 2014-189053
Apr. 8, 2015 (JP) ..... 2015-079392

(51) Int. Cl.

| | |
|---|---|
| ***C10L 1/22*** | (2006.01) |
| ***C10M 145/14*** | (2006.01) |
| ***C10M 149/10*** | (2006.01) |
| ***C10M 149/06*** | (2006.01) |
| ***C10M 177/00*** | (2006.01) |

(52) U.S. Cl.
CPC ..... *C10M 149/10* (2013.01); *C10M 149/06* (2013.01); *C10M 177/00* (2013.01); *C10M 2209/084* (2013.01); *C10M 2217/028* (2013.01); *C10N 2220/021* (2013.01); *C10N 2220/022* (2013.01); *C10N 2230/02* (2013.01); *C10N 2230/68* (2013.01); *C10N 2240/10* (2013.01); *C10N 2270/00* (2013.01)

(58) Field of Classification Search
CPC ..... C10M 2209/084; C10M 145/14
USPC ..... 508/291, 469
See application file for complete search history.

(56) References Cited

U.S. PATENT DOCUMENTS

| | | | | |
|---|---|---|---|---|
| 2010/0167970 | A1* | 7/2010 | Stoehr | B01F 17/0028 508/469 |
| 2014/0135243 | A1 | 5/2014 | Takagi et al. | |
| 2014/0315771 | A1 | 10/2014 | Iwai | |
| 2015/0175926 | A1 | 6/2015 | Matsui et al. | |
| 2015/0184109 | A1 | 7/2015 | Matsui et al. | |
| 2015/0197705 | A1 | 7/2015 | Matsui et al. | |
| 2015/0203781 | A1 | 7/2015 | Matsui et al. | |
| 2015/0203782 | A1 | 7/2015 | Matsui et al. | |
| 2015/0203785 | A1 | 7/2015 | Matsui et al. | |
| 2015/0322370 | A1 | 11/2015 | Matsui et al. | |

FOREIGN PATENT DOCUMENTS

| | | |
|---|---|---|
| JP | 8-176576 | 7/1996 |
| JP | 2009-506179 | 2/2009 |
| JP | 2012-197399 | 10/2012 |
| JP | 2013-104032 | 5/2013 |
| WO | 2014/017556 | 1/2014 |

OTHER PUBLICATIONS

International Search Report dated Oct. 27, 2015 in International (PCT) Application No. PCT/JP2015/076181.
Nakata, "Viscosity index improver for high performance engine oil", Sanyo Chemical News, Sanyo Chemical Industries Ltd., No. 476, 2013, 4 pages, with partial English translation.

* cited by examiner

*Primary Examiner* — Prem C Singh
*Assistant Examiner* — Francis C Campanell
(74) *Attorney, Agent, or Firm* — Wenderoth, Lind & Ponack, L.L.P.

(57) ABSTRACT

A viscosity index improver comprising a polymer which has a high viscosity index and good shear stability and which exhibits sufficient solubility in a lubricating base oil, a process for producing the same, and a lubricating oil composition containing the viscosity index improver are provided, wherein the viscosity index improver comprising a polymer satisfying the following (1) to (4): (1) weight-average molecular weight (Mw) of 200,000 or more and 600,000 or less; (2) number-average molecular weight (Mn) of 90,000 or more; (3) molecular weight distribution (Mw/Mn) of 4.0 or less; and (4) branching degree of 1.0 or more.

7 Claims, No Drawings

VISCOSITY INDEX IMPROVER, METHOD FOR PRODUCING THE SAME AND LUBRICATING OIL COMPOSITION

TECHNICAL FIELD

The present invention relates to a viscosity index improver having a specific structure, a method for producing the same, and a lubricating oil composition containing the same. In particular, it relates to a viscosity index improver having a high viscosity index and good shear stability and exhibiting sufficient solubility for a lubricating oil, and a process for producing the same.

BACKGROUND ART

In recent years, lubricating oils for internal combustion engines are strongly required to improve fuel economy characteristics, and as one means, reduction of friction loss due to lowering viscosity of a lubricating oil is cited. However, merely lowering the viscosity causes problems such as leakage and burning, so it is effective to add a viscosity index improver having the effect of keeping the viscosity low at low temperature while ensuring high viscosity at high temperature.

As the viscosity index improver, a viscosity index improver containing a polymer is known, and there are various kinds of them. Among them, a viscosity index improver comprising an alkyl (meth)acrylate polymer shows a high viscosity index improving effect. Meanwhile, the viscosity index improver comprising an alkyl (meth)acrylate polymer has a problem that shear stability is poor so that fuel saving characteristics are deteriorated for a long-term use (that is a poor long-life property).

As a means for improving the shear stability, for example, decrease of molecular weight of the polymer contained in the viscosity index improver is cited. In general, the lower the molecular weight, the less susceptible to shear and the smaller the degree of the molecular weight decreasing; and therefore, it is possible to suppress the viscosity lowering after shearing by using a low molecular weight viscosity index improver (refer to Patent Literature 1 and Non-Patent Literature 1). In addition, it has been reported that attempts have been made to improve the shear stability with a polymer having a star structure of which divinylbenzene is used as a core part (refer to Patent Literature 2).

CITATION LIST

Patent Literature

Patent Literature 1

Japanese Unexamined Patent Application Publication No. 2013-104032

Patent Literature 2

Japanese Unexamined Patent Application Publication No. 2012-197399

Non-Patent Literature

Non-Patent Literature 1

Nakata, "Viscosity index improver for high performance engine oil", Sanyo Chemical news, Sanyo Chemical Industries Ltd., 2013, No. 476

SUMMARY OF INVENTION

Technical Problem

However, in general, the lower the molecular weight, the lower the viscosity index improving effect tends to be; and therefore, when a low molecular weight viscosity index improver is used, the problem of lowering the viscosity index occurs. Furthermore, in order to adjust the viscosity to a desired degree, it is necessary to increase the amount of the viscosity index improver to be used, that tends to be disadvantageous in cost. Even when a polymer having a star structure of which divinylbenzene is used as a core part is used, there is still room for improvement in compatibility between the viscosity index and the shear stability.

The present invention has been achieved in view of the above circumstances, and an object of the present invention is to provide a viscosity index improver comprising a polymer which has a high viscosity index and good shear stability and which exhibits sufficient solubility in a lubricating base oil, a process for producing the same, and a lubricating oil composition containing the viscosity index improver.

Solution to Problem

The viscosity index improver of the present invention which solves the above problems is a viscosity index improver comprising a polymer which satisfies the following (1) to (4):

(1) weight-average molecular weight (Mw) of 200,000 or more and 600,000 or less;

(2) number-average molecular weight (Mn) of 90,000 or more;

(3) molecular weight distribution (Mw/Mn) of 4.0 or less;

(4) branching degree of 1.0 or more.

By using the polymer satisfying the above (1) to (4), a viscosity index improver which has a high viscosity index and good shear stability and which exhibits sufficient solubility in a lubricating base oil is obtained.

The viscosity index improver of the present invention preferably comprises a polymer obtained by polymerizing a monomer component in the presence of a tri- or higher functional mercaptan and/or a tri- or higher functional initiator.

As the polymer, a polymer obtained by polymerizing a maleimide monomer (a) represented by the following formula (1), that is referred to as a "component (a)", as an essential component of the monomer component is preferable.

(1)

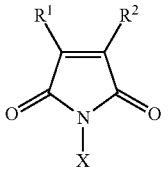

In the above formula, $R^1$ and $R^2$ independently represent a hydrogen atom or an alkyl group, and X represents a hydrogen atom, a linear, cyclic or branched alkyl group, which optionally has an aromatic ring, or an aryl group.

As the polymer, a polymer obtained by polymerizing an alkyl (meth)acrylate (b) having an aliphatic hydrocarbon group of 6 to 40 carbon atoms, that is referred to as a "component (b)", and an alkyl (meth)acrylate (c) having an aliphatic hydrocarbon group of 1 to 5 carbon atoms, that is referred to as a "component (c)", in addition to the component (a) as essential components of the monomer component, is preferable.

Viewing from another aspect, it is preferred that the viscosity index improver of the present invention comprises a polymer having a branch unit derived from a tri- or higher functional mercaptan and/or a branch unit derived from a tri- or higher functional initiator. Furthermore, the polymer preferably has a unit represented by the following formula (4). In the following formula (4), $R^1$, $R^2$ and X represent the same meanings as described above.

(4)

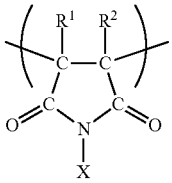

The polymer preferably has a unit derived from an alkyl (meth)acrylate having an aliphatic hydrocarbon group of 6 to 40 carbon atoms and a unit derived from an alkyl (meth)acrylate having an aliphatic hydrocarbon group of 1 to 5 carbon atoms in addition to the unit represented by the formula (4).

It is preferred that a content of the unit derived from the component (a) or the unit represented by the formula (4) is 5 parts by mass or more and 30 parts by mass or less, relative to 100 parts by mass of the polymer.

It is preferred that a content of the unit derived from the component (b) or the unit derived from an alkyl (meth) acrylate having an aliphatic hydrocarbon group of 6 to 40 carbon atoms is 50 parts by mass or more and less than 95 parts by mass, relative to 100 parts by mass of the polymer.

The present invention further provides a lubricating oil composition comprising the above-described viscosity index improver.

The present invention further provides a method for producing a viscosity index improver. The method for producing a viscosity index improver of the present invention comprises the step of polymerizing a monomer component in the presence of a tri- or higher functional mercaptan and/or a tri- or higher functional initiator. As the monomer component, it is preferable that a maleimide monomer (a) represented by the above formula (1) is used as an essential component of the monomer component, and more preferable that an alkyl (meth)acrylate (b) having an aliphatic hydrocarbon group of 6 to 40 carbon atoms and an alkyl (meth)acrylate (c) having an aliphatic hydrocarbon group of 1 to 5 carbon atoms are further used.

Advantageous Effects of Invention

By using the viscosity index improver of the present invention, shear stability and heat resistance can be improved as compared with a conventional lubricating oil composition. In addition, the viscosity index improver of the present invention facilitates ensuring sufficient solubility in a base oil though it has a high molecular weight, so that it gives a lubricating oil composition having a high viscosity index.

DESCRIPTION OF EMBODIMENTS

The present invention will be hereinafter described in detail. In the following description, the term "part" means "part by mass" and the term "%" means "mass %" unless otherwise noted. In addition, the term "A to B" indicating the range means that it is A or more and B or less.

[1. Viscosity Index Improver]

A viscosity index improver of the present invention comprises a specific polymer. The polymer used for the viscosity index improver of the present invention can be obtained by radically polymerizing a monomer component that includes a polymerizable monomer having various functional groups in the presence of a tri- or higher functional mercaptan and/or a tri- or higher functional initiator. The polymer according to the present invention can be used for a viscosity index improver.

Examples of the tri- or higher functional mercaptan include polyester compounds formed from a compound having three or more hydroxyl groups and a carboxyl group-containing mercaptan such as trimethylolpropane trimercaptoacetate, trimethylolpropane tri(3-mercaptopropionate), pentaerythritol tetrakis(mercaptoacetate), pentaerythritol tetrakis(3-mercaptopropionate), dipentaerythritol hexakis(mercaptoacetate) and dipentaerythritol hexakis(3-mercaptopropionate), triazine multifunctinal thiols, compounds having three or more mercapto groups per molecule obtained by adding hydrogen sulfide to a plurality of epoxy groups of a multifunctional epoxy compound, compounds having three or more mercapto groups per molecule obtained by esterifying a plurality of carboxyl groups of a multifunctional carboxylic acid and a mercaptoethanol, and the like. Regarding the tri- or higher functional mercaptan, one or more kind of that may be used alone or in combination thereof (for example, by mixing).

The used amount (total amount of addition) of the tri- or higher functional mercaptan may be appropriately determined according to a kind and an amount of a monomer to be used, polymerization conditions such as polymerization temperature and polymerization concentration, molecular weight of the target polymer and others, and is not particularly limited. From a viewpoint of obtaining the viscosity index improver containing a polymer having high base oil solubility and weight-average molecular weight of 100,000 or more, the used amount of the tri- or higher functional mercaptan is preferably 0.01 parts by mass or more, more preferably 0.05 parts by mass or more, and is preferably 5 parts by mass or less, more preferably 3 parts by mass or less, even more preferably 2 parts by mass or less, relative to 100 parts by mass of the monomer component. Within this range, molecular weight distribution thereof becomes narrow and the shear stability can be improved.

Examples of the tri- or higher functional initiator include, for example, organic peroxides having three or more functional groups such as 2,2-bis(4,4-t-butylperoxycyclohexyl) propane, tris(t-butylperoxy)triazine, and 3,3',4,4'-tetra(t-butylperoxycarbonyl)benzophenone; however, it is not particularly limited.

The used amount (total amount of addition) of the tri- or higher functional initiator may be appropriately determined according to a purpose and an application, and is not particularly limited. From a viewpoint of obtaining the viscosity index improver containing a polymer having high base oil solubility and weight-average molecular weight of 100,000 or more while considering the balance between polymerizability, adverse effects of decomposed substances and economic efficiency, the used amount of the tri- or higher functional initiator is preferably 0.01 parts by mass or more, more preferably 0.02 parts by mass or more, even more preferably 0.05 parts by mass or more, and is preferably 10 parts by mass or less, more preferably 5 parts by mass or less, even more preferably 2 parts by mass or less, relative to 100 parts by mass of the monomer component.

A polymer obtained by radical polymerization of a monomer component in the presence of the tri- or higher functional mercaptan and/or the tri- or higher functional initiator has a structure in which polymer chains are branched from the center. That is, the polymer contained in the viscosity index improver of the present invention has a branch unit derived from the tri- or higher functional mercaptan and/or a branch unit derived from the tri- or higher functional initiator. When the polymer contained in the viscosity index improver has such a structure, it is possible to improve shear stability of the viscosity index improver containing the polymer without significantly impairing solubility in a base oil.

In the case where the polymer contained in the viscosity index improver has a branch unit derived from the tri- or higher functional mercaptan, the polymer preferably has a branch unit represented by the following formula (7) (that is a chain transfer agent residue). In the following formula (7), $L_T$ represents a m-valent organic residue, and m represents a number of 0 or more. The m is preferably 0 to 5.

(7)

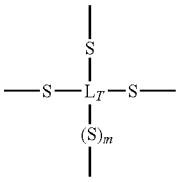

In the case where the polymer contained in the viscosity index improver has a branch unit derived from the tri- or higher functional initiator, the polymer preferably has a branch unit derived from a peroxide having three or more functional groups, and specifically, preferably has a branch unit represented by the following formula (8). In the following formula (8), $L_S$ represents a n-valent organic residue (an initiator residue), and n represents a number of 0 or more. The n is preferably 0 to 5.

(8)

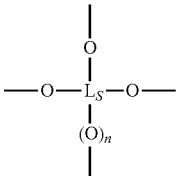

The polymer contained in the viscosity index improver may have either one of the branch unit derived from the tri- or higher functional mercaptan and the branch unit derived from the tri- or higher functional initiator, or may have both of them. Regarding the branch unit derived from the tri- or higher functional mercaptan, only one kind of that may be contained or two or more kinds of that may be contained. Also, regarding the branch unit derived from the tri- or higher functional initiator, only one kind of that may be contained or two or more kinds of that may be contained.

The content of the branch unit derived from the tri- or higher functional mercaptan in the polymer is preferably 0.01 parts by mass or more, more preferably 0.05 parts by mass or more, and is preferably 5 parts by mass or less, more preferably 3 parts by mass or less, even more preferably 2 parts by mass or less, relative to 100 parts by mass of the polymer. Within this range, the molecular weight distribution of the polymer becomes narrow and the shear stability can be improved. The content of the branch unit derived from the tri- or higher functional mercaptan is determined by dividing the used amount of the tri- or higher functional mercaptan by the mass of polymer.

The content of the branch unit derived from the tri- or higher functional initiator in the polymer is preferably 0.01 parts by mass or more, more preferably 0.02 parts by mass or more, even more preferably 0.05 parts by mass or more, and is preferably 10 parts by mass or less, more preferably 5 parts by mass or less, even more preferably 2 parts by mass or less, relative to 100 parts by mass of the polymer, from a viewpoint of obtaining the viscosity index improver containing the polymer having high base oil solubility and a weight-average molecular weight of 100,000 or more in the polymer. The content of the branch unit derived from the tri- or higher functional initiator is determined by dividing the used amount of the tri- or higher functional initiator by the mass of polymer.

The polymer contained in the viscosity index improver of the present invention preferably has a ring structure in the main chain, and the ring structure of the main chain is preferably a succinimide ring structure. Therefore, it is preferred that the polymer contained in the viscosity index improver of the present invention is obtained by polymerizing a maleimide monomer (a) represented by the following formula (1) (that is hereinafter referred to as a "component (a)") as an essential component of the monomer component.

(1)

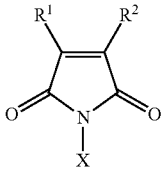

In the above formula (1), $R^1$ and $R^2$ independently represent a hydrogen atom or an alkyl group, and X represents a hydrogen atom, a linear, cyclic or branched alkyl group, which includes an alkyl group having an aromatic ring, or an aryl group. In the case where the X is an alkyl group, the alkyl group may be linear, cyclic or branched, and any substituent may be bonded to the alkyl group. The substituent may have an aromatic ring (for example, a phenyl group). In the case where the X is an aryl group, any substituent may be bonded to the aryl group.

In the case where the X is an alkyl group, it is preferred that the alkyl group has a cyclic structure, and as such alkyl group, an alkyl group having an aromatic ring (that is, an aralkyl group) such as a benzyl group and a cycloalkyl group such as a cyclohexyl group are preferable. As the aryl group, a phenyl group, a naphthyl group and an aryl group in which hydrogen of an aromatic ring is substituted are preferable.

Specific examples of the monomer component (a) include maleimide; a maleimide in which a linear or branched alkyl group of 1 to 20 carbon atoms is bonded to a nitrogen atom such as N-methylmaleimide, N-ethylmaleimide, N-isopropylmaleimide, N-butylmaleimide, N-isobutylmaleimide, N-tert-butylmaleimide, N-cyclohexylmaleimide, N-laurylmaleimide and N-stearylmaleimide; a maleimide in which a cyclic alkyl group of 5 to 10 carbon atoms is bonded to a nitrogen atom such as N-cyclohexylmaleimide; a maleimide in which an aryl group or aralkyl group of 6 to 12 carbon atoms bonded to a nitrogen atom such as N-phenylmaleimide, N-benzylmaleimide, N-chlorophenylmaleimide, N-methylphenylmaleimide, N-naphthylmaleimide, N-hydroxylphenylmaleimide, N-methoxyphenylmaleimide, N-carboxyphenylmaleimide, N-nitrophenylmaleimide and N-tribromophenylmaleimide; a maleimide in which a hydroxyl alkyl group is bonded to a nitrogen atom such as N-hydroxylethylmaleimide; and others. Among them, N-phenylmaleimide, N-cyclohexylmaleimide, N-isopropylmaleimide, N-benzylmaleimide, N-laurylmaleimide and N-stearylmaleimide are preferable in view of availability, economic efficiency and high solubility in a base oil. The above monomer component (a) may be used alone or in combination of two or more kinds.

By polymerizing a monomer component including the component (a), a polymer having a unit represented by the following formula (4), that is, a polymer having a succinimide ring structure in the main chain, is obtained. Therefore, the polymer contained in the viscosity index improver of the present invention preferably has a unit represented by the following formula (4). In the following formula (4), $R^1$, $R^2$ and X represent the same meanings as described above.

(4)

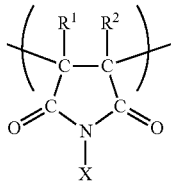

The content of the monomer component (a) is preferably 0.5 parts by mass or more, more preferably 2 parts by mass or more, even more preferably 5 parts by mass or more, and is preferably 35 parts by mass or less, more preferably 30 parts by mass or less, relative to 100 parts by mass of the total monomer components. The content of the unit derived from the monomer component (a) (that is, the unit represented by the above formula (4)) in the polymer is preferably 0.5 parts by mass or more, more preferably 2 parts by mass or more, even more preferably 5 parts by mass or more, and is preferably 35 parts by mass or less, more preferably 30 parts by mass or less, relative to 100 parts by mass of the polymer. The viscosity index improver containing the polymer obtained by using the monomer component (a) in the above range or the polymer having the unit derived from the monomer component (a) in the above range enables to enhance the shear stability while maintaining solubility in a base oil. Furthermore, it is expected to improve detergency and dispersibility of sludge and the like, and to suppress abrasion of a metal surface.

The polymer contained in the viscosity index improver of the present invention is preferably a (meth)acrylate polymer having a cyclic structure in the main chain, and more preferably, a polymer obtained by polymerizing an alkyl (meth)acrylate (b) having an aliphatic hydrocarbon group of 6 to 40 carbon atoms (that is hereinafter referred to as a "component (b)") and an alkyl (meth)acrylate (c) having an aliphatic hydrocarbon group of 1 to 5 carbon atoms (that is hereinafter referred to as a "component (c)") in addition to the component (a) as essential components of the monomer component.

As the monomer component (b), a (meth)acrylate represented by the following formula (2) is preferable. In the following formula (2), $R^3$ represents a hydrogen atom or a methyl group, and $R^4$ represents an alkyl group of 6 to 40 carbon atoms (preferably an alkyl group of 6 to 24 carbon atoms, and more preferably an alkyl group of 12 to 24 carbon atoms). The alkyl group of $R^4$ may be linear, cyclic or branched, and may have a substituent.

(2)

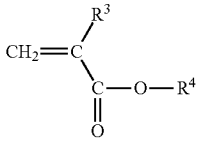

The monomer component (b) may be a monomer in which $R^3$ and $R^4$ are respectively single kinds, or may be a mixture of two or more monomers in which $R^3$ and/or $R^4$ are different from each other. In view of reactivity, $R^3$ is preferably a hydrogen atom or a methyl group.

Specific examples of the monomer component (b) include n-hexyl (meth)acrylate, 2-ethylhexyl (meth)acrylate, n-octyl (meth)acrylate, nonyl (meth)acrylate, decyl (meth)acrylate, undecyl (meth)acrylate, dodecyl (meth)acrylate, tridecyl (meth)acrylate, tetradecyl (meth)acrylate, pentadecyl (meth) acrylate, hexadecyl (meth)acrylate, heptadecyl (meth)acrylate, stearyl (meth)acrylate, nonadecyl (meth)acrylate, eicosyl (meth)acrylate, behenyl (meth)acrylate, tetracosyl (meth)acrylate, 2-decyltetradecyl (meth)acrylate, cyclohexyl (meth)acrylate, menthyl (meth)acrylate, isobornyl (meth)acrylate, dicyclopentanyl (meth)acrylate, adamantyl (meth)acrylate, and others. Among them, in view of availability, economic efficiency and high solubility in a base oil, 2-ethylhexyl (meth)acrylate, dodecyl (meth)acrylate, stearyl (meth)acrylate, eicosyl (meth)acrylate, behenyl (meth)acrylate, tetracosyl (meth)acrylate, 2-decyltetradecyl (meth) acrylate and cyclohexyl (meth)acrylate are preferable. The above monomer component (b) may be used alone or in combination of two or more kinds.

By polymerizing a monomer component including the component (b), a unit derived from an alkyl (meth)acrylate having an aliphatic hydrocarbon group of 6 to 40 carbon atoms is introduced into the polymer. Therefore, the polymer contained in the viscosity index improver of the present invention preferably has a unit derived from an alkyl (meth) acrylate having an aliphatic hydrocarbon group of 6 to 40 carbon atoms, in addition to the unit represented by the above formula (4), and more preferably has a unit represented by the following formula (5). In the following formula (5), $R^3$ and $R^4$ represent the same meanings as described above.

(5)

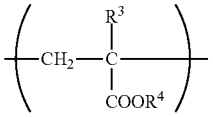

The content of the monomer component (b) is preferably 50 parts by mass or more, more preferably 55 parts by mass or more, and is preferably less than 95 parts by mass, more preferably 93 parts by mass or less, even more preferably 90 parts by mass or less, relative to 100 parts by mass of the total monomer components. The content of the unit derived from the monomer component (b) (that is, the unit derived from an alkyl (meth)acrylate having an aliphatic hydrocarbon group of 6 to 40 carbon atoms) in the polymer is preferably 50 parts by mass or more, more preferably 55 parts by mass or more, and is preferably less than 95 parts by mass, more preferably 93 parts by mass or less, even more preferably 90 parts by mass or less, relative to 100 parts by mass of the polymer. The viscosity index improver containing the polymer obtained by using the monomer component (b) in the above range or the polymer having the unit derived from the monomer component (b) in the above range comes to have high solubility in base oils of various compositions.

As the monomer component (c), a (meth)acrylate represented by the following formula (3) is preferable. In the following formula (3), $R^5$ represents a hydrogen atom or a methyl group, and $R^6$ represents an aliphatic hydrocarbon group of 1 to 5 carbon atoms (preferably an alkyl group of 1 to 5 carbon atoms). The aliphatic hydrocarbon group of $R^6$ may be linear, cyclic or branched, and may have a substituent.

(3)

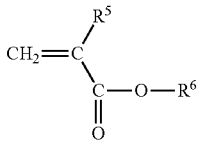

The monomer component (c) may be a monomer in which $R^5$ and $R^6$ are respectively a single kinds, or may be a mixture of two or more monomers in which $R^5$ and/or $R^6$ are different from each other. In view of reactivity, $R^5$ is preferably a hydrogen atom or a methyl group. In addition, in view of improving a viscosity index, it is preferable that the aliphatic hydrocarbon group of $R^6$ is linear or branched.

Specific examples of the monomer component (c) include, for example, methyl (meth)acrylate, ethyl (meth) acrylate, n-propyl (meth)acrylate, iso-propyl (meth)acrylate, n-butyl (meth)acrylate, iso-butyl (meth)acrylate, t-butyl (meth)acrylate, n-amyl (meth)acrylate, iso-amyl (meth) acrylate, t-amyl (meth)acrylate, neopentyl (meth)acrylate, and others. In particular, it is preferable that at least methyl (meth)acrylate is included as the monomer component (c). When the monomer component (c) includes methyl (meth) acrylate, the viscosity index improver which exhibits a high viscosity index improvement effect and has high heat resistance and shear stability is obtained. The above monomer component (c) may be used alone or in combination of two or more kinds.

By polymerizing a monomer component including the component (c), a unit derived from an alkyl (meth)acrylate having an aliphatic hydrocarbon group of 1 to 5 carbon atoms is introduced into the polymer. Therefore, the polymer contained in the viscosity index improver of the present invention preferably has a unit derived from an alkyl (meth) acrylate having all aliphatic hydrocarbon group of 1 to 5 carbon atoms, in addition to the unit represented by the above formula (4), and more preferably has a unit represented by the following formula (6). In the following formula (6), $R^5$ and $R^6$ represent the same meanings as described above. More preferably, the polymer contained in the viscosity index improver of the present invention has a unit derived from an alkyl (meth)acrylate having an aliphatic hydrocarbon group of 6 to 40 carbon atoms and a unit derived from all alkyl (meth)acrylate having an aliphatic hydrocarbon group of 1 to 5 carbon atoms, in addition to the unit represented by the above formula (4).

(6)

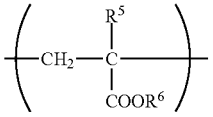

The content of the monomer component (c) is preferably 2 parts by mass or more, more preferably 5 parts by mass or more, and is preferably 40 parts by mass or less, more preferably 35 parts by mass or less, even more preferably 30 parts by mass or less, relative to 100 parts by mass of the total monomer components. The content of the unit derived from the monomer component (c) (that is, the unit derived from an alkyl (meth)acrylate having an aliphatic hydrocarbon group of 1 to 5 carbon atoms) in the polymer is preferably 2 parts by mass or more, more preferably 5 parts by mass or more, and is preferably 40 parts by mass or less, more preferably 35 parts by mass or less, even more preferably 30 parts by mass or less, relative to 100 parts by mass of the polymer. When the content of the monomer component (c) or the content of the unit derived from the monomer component (c) is in the above range, copolymerizability with other components is good, polymerization velocity is enhanced, a polymerization rate is high, and productivity is good. In addition, the shear stability and the base oil solubility of the viscosity index improver obtained by copolymerization are further improved.

The monomer component for synthesizing the polymer of the present invention may contain a radically polymerizable monomer other than the components (a), (b) and (c) (that is hereinafter referred to as a "component (d)"). The radically polymerizable monomer of the component (d) is classified into a monofunctional monomer having one radically polymerizable group in the molecule and a multifunctional monomer having two or more radically polymerizable groups in the molecule.

Examples of the monofunctional monomer include (meth) acrylates other than the components (b) and (c), unsaturated mono- or dicarboxylate esters, unsaturated carboxylic acids, vinylaromatic compounds, vinyl esters, vinyl ethers, olefins, vinyl cyanide, N-vinyl compounds, (meth)acrylamide and others. These monofunctional monomers may be used alone, or two or more kinds of them may be used in combination.

Examples of the (meth)acrylate other than the components (b) and (c) include, for example, benzyl (meth)acrylate, phenyl (meth)acrylate, 2-hydroxyethyl (meth)acrylate, 2-hydroxybutyl (meth)acrylate, 2-methoxyethyl (meth)acrylate, tetrahydrofurfuryl (meth)acrylate, N,N-dimethylaminoethyl (meth)acrylate, morpholinoalkylene (meth)acrylate, methyl α-hydroxymethylacrylate, polyethyleneglycol mono(meth)acrylate and others.

Examples of the unsaturated mono- or dicarboxylate ester include, for example, butyl crotonate, octyl crotonate, dibutyl maleate, dilauryl maleate, dioctyl fumarate, distearyl fumarate and others.

Examples of the unsaturated carboxylic acid include, for example, (meth)acrylic acid, maleic acid, fumaric acid, maleic anhydride and others.

Examples of the vinyl aromatic compound include, for example, styrene monomers such as styrene, α-methyl styrene, vinyl toluene and methoxystyrene, 2-vinyl pyridine, 4-vinyl pyridine and others.

Examples of the vinyl ester include, for example, vinyl acetate, vinyl propionate, vinyl octylate and others.

Examples of the vinyl ether include, for example, methyl vinyl ether, butyl vinyl ether, octyl vinyl ether, dodecyl vinyl ether and others.

Examples of the olefin include, for example, ethylene, propylene, 1-butene, isobutene, 1-tetradecene, 1-octadecene, diisobutene and others.

Examples of the vinyl cyanide include, for example, acrylonitrile, methacrylonitrile and others.

Examples of the N-vinyl compound include, for example, N-vinylpyrrolidone, N-vinylcaprolactam, N-vinylimidazole, N-vinylmorpholine, N-vinylacetamide and others.

Examples of the (meth)acrylamide include, for example, N,N-dimethyl (meth)acrylamide, N,N-diethyl (meth)acrylamide, N,N-dibutyl (meth)acrylamide, N-methylol (meth) acrylamide, acryloyl morpholine and others.

Among these monofunctional monomers, 2-hydroxyethyl (meth)acrylate, N,N-dimethylaminoethyl (meth)acrylate, methyl α-hydroxymethylacrylate, N-vinylpyrrolidone, N,N-dimethyl (meth)acrylamide and acryloyl morpholine are preferable.

The content of the monofunctional monomer of the monomer component (d) is preferably 0 parts by mass or more and 30 parts by mass or less, more preferably 25 parts by mass or less, and even more preferably 20 parts by mass or less, relative to 100 parts by mass of the total monomer components. The content of the unit derived from the monofunctional monomer of the component (d) in the polymer is preferably 0 parts by mass or more and 30 parts by mass or less, more preferably 25 parts by mass or less, and even more preferably 20 parts by mass or less, relative to 100 parts by mass of the polymer.

However, in the case of using the styrene monomer, the content of the styrene monomer is preferably 2 parts by mass or less, relative to 100 parts by mass of the total monomer components. The content of the unit derived from the styrene monomer in the polymer is preferably 2 parts by mass or less, relative to 100 parts by mass of the polymer. When the content of the unit derived from the styrene monomer exceeds 2 parts by mass, solubility in a base oil and a viscosity index of the viscosity index improver containing the polymer tend to be lowered.

In the case where olefin is used as the monomer, the content of olefin is preferably 5 parts by mass or less and more preferably 3 parts by mass or less, relative to 100 parts by mass of the total monomer components. The content of unit derived from olefin in the polymer is preferably 5 parts by mass or less and more preferably 3 parts by mass or less, relative to 100 parts by mass of the polymer. When the content of unit derived from olefin exceeds 5 parts by mass, a viscosity index of the viscosity index improver containing the polymer tends to be lowered.

Examples of the multifunctional monomer of the monomer component (d) include multifunctional (meth)acrylic compounds such as a multifunctional (meth)acrylate, a vinyl ether group-containing (meth)acrylate, an allyl group-containing (meth)acrylate, a multifunctional (meth)acryloyl group-containing isocyanurate and a multifunctional urethane (meth)acrylate, multifunctional maleimide compounds, multifunctional vinyl ethers, multifunctional allyl compounds, multifunctional aromatic vinyl compounds and others. These multifunctional monomers may be used alone or in combination of two or more.

Examples of the multifunctional (meth)acrylate (that is a multifunctional (meth)acrylate ester) include, for example, ethyleneglycol di(meth)acrylate, diethyleneglycol di(meth) acrylate, polyethyleneglycol di(meth)acrylate, hexanediol di(meth)acrylate, bisphenol-A alkylene oxide di(meth)acrylate, trimethylolpropane tri(meth)acrylate, 2,2'-[oxybis (methylene)] bisacrylic acid, dialkyl-2,2'-[oxybis(methylene)] bis-2-propenoate and others.

Examples of the vinyl ether group-containing (meth) acrylate (that is a vinyl ether group-containing (meth)acrylate ester) include, for example, 2-vinyloxyethyl (meth) acrylate, 4-vinyloxybutyl (meth)acrylate, 2-(vinyloxyethoxy)ethyl (meth)acrylate and others.

Examples of the allyl group-containing (meth)acrylate (that is an allyl group-containing (meth)acrylate ester) include, for example, allyl (meth)acrylate, methyl α-allyloxymethylacrylate, stearyl α-allyloxymethylacrylate, 2-decyltetradecyl α-allyloxymethylacrylate and others.

Examples of the multifunctional (meth)acryloyl group-containing isocyanurate include, for example, tri(acryloyloxyethyl) isocyanurate, tri(methacryloyloxyethyl) isocyanurate and others.

Examples of the multifunctional urethane (meth)acrylate (that is a multifunctional urethane (meth)acrylate ester) include, for example, a multifunctional urethane (meth) acrylate obtained by the reaction of a multifunctional isocyanate such as tolylene diisocyanate, isophorone diisocyanate and xylylene diisocyanate, with a hydroxyl group-containing (meth)acrylate ester such as 2-hydroxyethyl (meth)acrylate and 2-hydroxypropyl (meth)acrylate, and others.

Examples of the multifunctional maleimide compound include, for example, 4,4'-diphenylmethane bismaleimide, m-phenylene bismaleimide, bisphenol-A diphenyl ether bismaleimide, 1,6-bismaleimide-(2,2,4-trimethyl)hexane and others.

Examples of the multifunctional vinyl ether include, for example, ethyleneglycol divinyl ether, diethyleneglycol divinyl ether, polyethyleneglycol divinyl ether, hexanediol divinyl ether, bisphenol-A alkylene oxide divinyl ether, trimethylolpropane trivinyl ether and others.

Examples of the multifunctional allyl compound include, for example, multifunctional allyl ethers such as ethyleneglycol diallyl ether, diethyleneglycol diallyl ether, polyethyleneglycol diallyl ether, hexanediol diallyl ether, bisphenol-A alkylene oxide diallyl ether, trimethylolpropane triallyl ether and ditrimethylolpropane tetraallyl ether; multifunctional allyl group-containing isocyanurates such as triallyl isocyanurate; multifunctional allyl esters such as diallyl phthalate and diallyl diphenate; bisallylnadiimide compounds; bisallylnadiimide compounds and others.

Examples of the multifunctional aromatic vinyl compound include, for example, divinylbenzene and others.

The content of the multifunctional monomer of the monomer component (d) is preferably 0 parts by mass or more and 5 parts by mass or less, more preferably 3 parts by mass or less, and even more preferably 2 parts by mass or less, relative to 100 parts by mass of the total monomer components. The content of the unit derived from the multifunctional monomer of the component (d) in the polymer is preferably 0 parts by mass or more and 5 parts by mass or less, more preferably 3 parts by mass or less, and even more preferably 2 parts by mass or less, relative to 100 parts by mass of the polymer. In this case, the shear stability of the viscosity index improver containing the polymer can be improved without significantly impairing the solubility in a base oil, due to adopting a branched structure of the polymer or the like.

However, in the case of a multifunctional monomer that undergoes polymerization while cycling, such as 2,2'-[oxybis(methylene)] bisacrylic acid, dialkyl-2,2'-[oxybis(methylene)] bis-2-propenoate, methyl α-allyloxymethylacrylate, stearyl α-allyloxymethylacrylate and 2-decyltetradecyl α-allyloxymethylacrylate, the content of the unit derived from such multifunctional monomer in the polymer is preferably 0 parts by mass or more and 30 parts by mass or less, more preferably 25 parts by mass or less, and even more preferably 20 parts by mass or less, relative to 100 parts by mass of the polymer. The same is also applied to the content of the multifunctional monomer relative to 100 parts by mass of the total monomer components. In this case, due to the effect of introducing a ring structure into the main chain, heat resistance of the viscosity index improver containing the polymer can be improved and the shear stability is improved.

When the unit derived from the multifunctional monomer exceeds the above range, gelation may proceed during polymerization or solubility of the viscosity index improver containing the polymer in a base oil may be deteriorated.

The viscosity index improver of the present invention can be obtained by a production method comprising the step of polymerizing a monomer component in the presence of tri- or higher functional mercaptan and/or tri- or higher functional initiator (that is a polymerization step). A polymerization method of the monomer component in the polymerization step may be, for example, bulk polymerization, solution polymerization, suspension polymerization, emulsion polymerization or the like, and is not particularly limited. In the case of using a dispersion medium, an emulsifying agent, a dispersing agent or the like, there is no particular limitation on them and known ones can be used.

Preferable conditions such as the kind and amount of the tri- or higher functional mercaptan and/or the tri- or higher functional initiator used in the polymerization step are as described above. At the time of polymerization, the tri- or higher functional mercaptan and/or the tri- or higher functional initiator may be added all at once or dividedly. A bi- or less functional mercaptan or a bi- or less functional initiator may be used in combination.

In the polymerization step, it is preferable to essentially use the above-mentioned monomer (a) as the monomer component. Moreover, it is more preferable to further use the above-mentioned monomer component (b) and the monomer component (c) in addition to the monomer component (a). As the monomer component, the above-mentioned monomer component (d) may be used in combination. Preferable conditions such as the type and used amount of each of these monomer components are as described above.

A solvent used for the polymerization is not particularly limited as long as it is inactive to the polymerization reaction, and can be appropriately selected according to the polymerization mechanism, the kind and amount of the monomer used, the kind and amount of the polymerization initiator or a polymerization catalyst and the like. From a viewpoint of ensuring solubility of the polymer and easy solvent replacement to a base oil after polymerization, toluene, xylene, hexane, cyclohexane, methyl ethyl ketone or tetrahydrofuran is preferably used as the solvent for polymerization. Or, a lubricating base oil described below can also be suitably used as the solvent. In this case, solvent replacement after polymerization is unnecessary and the process is simplified, that is more preferable. These solvents may be used alone, or two or more of them may be used in combination. The used amount of the solvent is not particularly limited, and from a viewpoint of obtaining the polymer having weight-average molecular weight of 100,000 or more, it is preferable that the concentration of the total amount of the monomer component, the polymerization initiator and other components is about 40 mass % or more and 100 mass % or less.

In the polymerization step, an acidic substance may be used as an additive in polymerizing the monomer component. By using an acidic substance, the Michael addition reaction between the monomer component (a) and the tri- or higher functional mercaptan can be suppressed, and the unit derived from the monomer component (a) can be efficiently introduced into the polymer. In addition, a polymerization rate of each monomer other than the component (a) may increase.

The acidic substance is not particularly limited, as long as it is able to adjust the pH in the range of 2.0 to 6.5 (preferably pH 3.0 to 5.5) when a certain amount of that is added to water of the same mass as all the components such as the monomers and solvents used for polymerization, and for example, an organophosphorus compound or an organic acid is preferably used. Examples of the organic phosphorus compound include alkyl (aryl) phosphorous acid and monoester thereof, dialkyl (aryl) phosphinic acid, alkyl (aryl) phosphonic acid and monoester thereof, alkylphosphinic acid, di- or monoester of phosphorous acid, di- or monoester of phosphoric acid and others. Examples of the organic acid include acetic anhydride, propionic anhydride, phthalic anhydride and others. These organophosphorus compounds or organic acids may be used alone, or two or more of them may be used in combination. The used amount of the acidic substance may be 0 mass % or more, preferably 5 mass % or less, more preferably 1 mass % or less, and even more preferably 0.5 mass % or less, relative to 100 parts by mass of the total monomer component.

Polymerization temperature in polymerizing the monomer component is not particularly limited, and may be appropriately set according to the polymerization mechanism, the kind and amount of the monomer used, the kind and amount of the polymerization initiator or a polymerization catalyst and the like; however, it is preferably 0° C. or higher, more preferably 25° C. or higher, and is preferably 200° C. or lower, more preferably 150° C. or lower. When the polymerization temperature is lower than 0° C., the polymerization reaction becomes extremely slow, and when it exceeds 200° C., the reaction becomes severe and the control becomes difficult; and thus, it is not preferable either.

The weight-average molecular weight (Mw) of the polymer contained in the improver of the present invention is preferably 100,000 or more, more preferably 200,000 or more, even more preferably 300,000 or more, still even more preferably 360,000 or more, and is preferably 600,000 or less, more preferably 580,000 or less, even more preferably 550,000 or less. When the weight-average molecular weight of the polymer is less than the above lower limit value, the viscosity index of the lubricating oil composition is made low, and it becomes necessary to increase the used amount of the viscosity index improver in order to adjust the viscosity to a desired degree, that is disadvantageous in terms of cost. When the weight-average molecular weight of the polymer is excessively large, solubility of the viscosity index improver in a base oil tends to be insufficient and the shear stability of the lubricating oil composition tends to decrease.

The number-average molecular weight (Mn) of the polymer contained in the viscosity index improver of the present invention is preferably 90,000 or more, more preferably in the range of 90,000 to 300,000 and even more preferably in the range of 90,000 to 200,000.

The molecular weight distribution (Mw/Mn) calculated from the Mw and the Mn is preferably 4.0 or less, more preferably 3.5 or less and even more preferably 3.0 or less. When the molecular weight distribution exceeds 4.0, solubility of the viscosity index improver in a base oil may become insufficient or the shear stability of the lubricating oil composition may decrease, that is undesirable. Meanwhile, the lower limit of the molecular weight distribution is preferably 1.0; however, in view of easily synthesis of the polymer, the molecular weight distribution (Mw/Mn) is preferably 1.5 or more, more preferably 2.0 or more and even more preferably 2.3 or more. In the present invention, the Mw and the Mn are values measured by the methods described in Examples of described below.

As a method for controlling the molecular weight, a known method can be employed. For example, it can be controlled by adjusting the amount and kind of the polymerization initiator or a polymerization catalyst, polymerization temperature, the kind and amount of the chain transfer agent, and the like. As a method of controlling the molecular weight distribution, living radical polymerization can also be employed. As a specific method, the RAFT method, the NMP method, the ATRP method and the like are famous. More information is outlined in Aldrich Material Matters, Vol. 5, No. 1, 2010. As an example of use, for example in the case of the RAFT method, 2,2'-azobisisobutyronitrile as a polymerization initiator and cumyl dithiobenzoate as a polymerization catalyst are used in JP-A-2012-197399.

Branching degree of the polymer contained in the viscosity index improver of the present invention is preferably 1.0 or more, more preferably 1.4 or more, and is preferably 10.0 or less, more preferably 6.0 or less, even more preferably 4.0 or less. When the branching degree is less than 1.0, the branched structure of the polymer is not sufficient and improvement of the shear stability is not expected. The branching degree in the present invention corresponds to the average of number of branch points per molecule of the polymer and is a value measured by the method described in Examples below. Logically, for example, the branching degree of a straight chain polymer without branching is 0, the branching degree of a polymer in which three polymer chains extend from only one branch point is 1, the branching degree of a polymer in which four polymer chains extend from that is 2, and the branching degree of a polymer in which five polymer chains extend from that is 3.

The content of the polymer described above in the viscosity index improver is not particularly limited as long as it does not impair the effect of the present invention; however, the viscosity index improver of the present invention preferably contains the above-described polymer as a main component. The content of the polymer in the viscosity index improver is, for example, preferably 50 parts by mass or more, more preferably 80 parts by mass or more and even more preferably 90 parts by mass or more, relative to 100 parts by mass of the viscosity index improver. The viscosity index improver may substantially consist of only the above-described polymer.

The SP value (solubility parameter) of the polymer contained in the viscosity index improver of the present invention is preferably 9.0 or higher, more preferably 9.1 or higher, even more preferably 9.2 or higher, and is preferably 9.6 or lower, more preferably 9.5 or lower, even more preferably 9.4 or lower. The SP value of a base oil generally has a value of about 8.0 to 8.5, and when the SP value of the polymer is 9.0 or higher, the viscosity index of the lubricating oil composition is easily increased, and when the SP value is 9.6 or lower, solubility of the viscosity index improver in a base oil is easily ensured. The SP value is obtained by a method described in Examples below.

The viscosity index improver of the present invention is able to attain a viscosity index improvement effect and shear stability at a high level. As a specific numerical value of the shear stability, PSSI (Permanent Shear Stability index: ASTM D 6022) or decomposition starting temperature can be used as an indicator.

The PSSI of the viscosity index improver is preferably 40 or less, more preferably 35 or less, even more preferably 30 or less, and particularly preferably 25 or less. The PSSI is preferably 0.1 or more, more preferably 0.5 or more, even more preferably 2 or more, and particularly preferably 5 or more. When the PSSI is less than 0.1, the viscosity index improving effect is small and the cost may be increased. When the PSSI exceeds 40, the shear stability and storage stability may be deteriorated.

The decomposition starting temperature of the viscosity index improver is preferably 290° C. or higher, more preferably 295° C. or higher, even more preferably 300° C. or higher, particularly preferably 310° C. or higher, and is preferably 500° C. or lower, more preferably 450° C. or lower, even more preferably 400° C. or lower, particularly preferably 380° C. or lower. When the decomposition starting temperature of the viscosity index improver is raised, heat resistance is enhanced and the thermal decomposition stability and the shear stability are improved. Meanwhile, when the heat resistance is excessively increased, solubility in the base oil tends to be insufficient and the viscosity index tends to decrease.

The viscosity index improver of the present invention contains the above-described polymer as a main component, and preferably contains 70 mass % or more, more preferably 90 mass % or more, even more preferably 95 mass % or more, particularly preferably 99 mass % or more and 100 mass % or less of the polymer in 100 mass % of the viscosity index improver.

[2. Composition Containing Viscosity Index Improver and Base Oil]

The present invention also provides a lubricating oil composition containing the viscosity index improver of the present invention. Blending the viscosity index improver of the present invention with a lubricating base oil gives a lubricating oil composition. The lubricating oil composition may be used as a lubricating oil without further diluted with a lubricating base oil or may be diluted with a lubricating base oil to use as a lubricating oil. In the latter case, the lubricating oil composition is used as a stock solution, that may hereinafter be referred to as a "base oil composition".

As the lubricating base oil, a known lubricating base oil can be used without particular limitation, and a mineral base oil and a synthetic base oil are suitably cited. Examples of the mineral base oil include a paraffin-base base oil and a naphthen-base base oil. The mineral base oil include that obtained by subjecting a raw material base oil to solvent refining, hydrocracking or hydroisomerization treatment. Examples of the synthetic base oil include a hydrocarbon-base base oil, an ester-base base oil, an ether-base base oil, a silicone-base base oil and a fluorine-base base oil. As described above, the lubricating base oil can also be used as the solvent for polymerization for obtaining the polymer contained in the viscosity index improver.

Preferred specific examples of the mineral base oil include base oils obtained by purifying the following base oils (1) to (7) as raw material oils and/or a lubricating oil fraction recovered from this raw material oil using a predetermined purification method and recovering a lubricating oil fraction. Specifically, the following base oils (8) and (9), which are obtained by subjecting a base oil selected from the following (1) to (7) or a lubricating oil fraction recovered from this base oil to a predetermined treatment, are preferable.

(1) distillate oil (WVGO) obtained by vacuum distillation of an atmospheric distillation residual oil of a paraffin-base crude oil and/or a mixed-base crude oil;
(2) wax obtained by a dewaxing process of a lubricating oil (slack wax and the like) and/or synthetic wax obtained by a gas to liquid (GTL) process and the like (Fischer Tropsch wax, GTL wax, and the like);
(3) mixed oil of one or more kinds selected from the base oils (1) to (2) and/or a mild hydrocracking-treated oil of this mixed oil;
(4) mixed oil of two or more kinds selected from the base oils (1) to (3);
(5) deasphalted oil (DAO) of any one of the base oils (1) to (4);
(6) mild hydrocracking-treated oil (MHC) of the base oil (5);
(7) mixed oil of two or more kinds selected from the base oils (1) to (6);
(8) hydrocracked mineral oil obtained by hydrocracking the base oil selected from the base oils (1) to (7) or a lubricating oil fraction recovered from this base oil, subjecting its product or a lubricating oil fraction recovered from its product by distillation or the like to a dewaxing treatment such as solvent dewaxing or catalytic dewaxing, and further optionally distilling after the dewaxing treatment;
(9) hydroisomerized mineral oil obtained by hydroisomerizing the base oil selected from the base oils (1) to (7) or a lubricating oil fraction recovered from this base oil, subjecting its product or a lubricating oil fraction recovered from its product by distillation or the like to a dewaxing treatment such as solvent dewaxing or catalytic dewaxing, and further optionally distilling after the dewaxing treatment.

Specific examples of the synthetic base oil include poly-α-olefins or hydrides thereof, isobutene oligomers or hydrides thereof, isoparaffins, alkylbenzenes, alkylnaphthalenes, diesters such as ditridecylglutarate, di-2-ethylhexyl adipate, diisodecyl adipate, ditridecyl adipate and di-2-ethylhexyl sebacate, polyol esters such as trimethylolpropane caprylate, trimethylolpropane pelargonate, pentaerythritol 2-ethylhexanoate and pentaerythritol pelargonate, polyoxyalkylene glycols, dialkyl diphenyl ethers, polyphenyl ethers and others; and among them, poly-α-olefins are preferable. Typical examples of the poly-α-olefin include oligomers or co-oligomers of α-olefin having 2 to 32 carbon atoms, preferably 6 to 16 carbon atoms, such as 1-octene oligomer, decene oligomer and ethylene-propylene co-oligomer, and hydrides thereof. Kinematic viscosity of the synthetic base oil at 100° C. is preferably 1 to 20 $mm^2/s$.

As the lubricating base oil to be blended in the lubricating oil composition, the base oil (8) or (9), that is obtained by subjecting the base oil selected from the base oils (1) to (7) or a lubricating oil fraction recovered from this base oil to the above-described treatment, is particularly preferred. It is also preferable to use base oils belonging to Group III based on the classification by the American Petroleum Institute (API). As the lubricating base oil to be blended in the lubricating oil composition, the synthetic base oil described above may be used.

In the lubricating oil composition of the present invention, the above-described lubricating base oil may be used singly or in combination with one or more of other base oils. In the case of using the lubricating base oil and another base oil in combination to prepare a mixed base oil, the mixed base oil preferably contains at least the lubricating base oil (8) or (9). The ratio of the lubricating base oil (8) or (9) in the mixed base oil is preferably 30 mass % or more, more preferably 50 mass % or more and even more preferably 70 mass % or more.

The viscosity index of the lubricating base oil is preferably 100 or higher, more preferably 120 or higher, and is preferably 160 or lower. When the viscosity index is less than the above lower limit value, friction coefficient tends to increase, thereby decreasing anti-wear property, as well as viscosity-temperature characteristic, the heat/oxidation stability and volatilization prevention property deteriorate. When the viscosity index exceeds the above upper limit value, low-temperature viscosity characteristic tends to deteriorate. Here, the viscosity index referred to in the present invention means a viscosity index measured in accordance with JIS K 2283.

The viscosity index of the lubricating oil composition is preferably 200 or higher, more preferably 230 or higher, and is preferably 400 or lower, more preferably 300 or lower. When the viscosity index is within this range, it is excellent in fuel economy, heat/oxidation stability and storage stability.

The content of the viscosity index improver of the present invention in the lubricating oil composition is not particularly limited, and for example, it is preferably 0.01 mass % or more, more preferably 0.1 mass % or more, even more preferably 0.5 mass % or more, and is preferably 70 mass % or less, more preferably 60 mass % or less, even more preferably less than 50 mass %, based on the total amount of the lubricating oil composition. In the case where the lubricating oil composition is used as a lubricating oil without further diluted with a lubricating base oil, the content of the viscosity index improver of the present invention in the lubricating oil composition is preferably 0.01 mass % or more, more preferably 0.1 mass % or more, even more preferably 0.5 mass % or more, and is preferably 20 mass % or less, more preferably 15 mass % or less, even more preferably 10 mass % or less, based on the total amount of the lubricating oil composition. In, the case where the lubricating oil composition of the present invention is used as the base oil composition, the content of the viscosity index improver of the present invention in the base oil composition is preferably, for example, 5 mass % or more, more preferably 10 mass % or more, even more preferably 20 mass % or more, and is preferably 70 mass % or less, more preferably 60 mass % or less, even more preferably less than 50 mass %.

The lubricating oil composition of the present invention contains the viscosity index improver of the present invention and a lubricating base oil as essential components and may further contain optional additives and others. For example, the lubricating oil composition preferably further contains at least one additive selected from the group consisting of a pour point depressant, an anti-wear agent, a metal-base detergent dispersant, an ashless detergent dispersant, an antioxidant, a corrosion inhibitor, an antifoaming agent and a friction modifier.

As the pour point depressant, any pour point depressant used for lubricating oils can be used. Examples of the pour point depressant include, for example, polymethacrylates, naphthalene-chlorinated paraffin condensation products, phenol-chlorinated paraffin condensation products, and others. Among them, polymethacrylates are preferable.

As the anti-wear agent (or an extreme pressure agent), any anti-wear agent or extreme pressure agent used for lubricating oils can be used. As the anti-wear agent (or the extreme pressure agent), a sulfur-base extreme pressure agent, a phosphorus-base extreme pressure agent and sulfur-phosphorus-base extreme pressure agent can be used, for example; and specific examples thereof include zinc dialkyl dithiophosphate (ZnDTP), phosphite esters, thiophosphite esters, dithiophosphite esters, trithiophosphite esters, phosphate esters, thiophosphate esters, dithiophosphate esters, trithiophosphate esters, amine salts of them, metal salts of them, derivatives of them, dithiocarbamate, zinc dithiocarbamate, MoDTC, disulfides, polysulfides, sulfurized olefins, sulfurized greases and others. Among them, sulfur-base extreme pressure agents are preferable, and sulfurized greases are particularly preferable.

Examples of the metal-base detergent dispersant include a normal salt or a basic salt such as an alkali metal/alkaline earth metal sulfonate, an alkali metal/alkaline earth metal phenate, an alkali metal/alkaline earth metal salicylate and others. Examples of the alkali metal include sodium, potassium and others, and examples of the alkaline earth metal include magnesium, calcium, barium and others; and magnesium or calcium is preferable, and calcium is especially preferable.

As the ashless detergent dispersant, any ashless detergent dispersant used in lubricating oils can be used. Examples of the ashless detergent dispersant include, for example, mono- or bis-succinimides having at least one linear or branched alkyl or alkenyl group of 40 to 400 carbon atoms in the molecule, benzylamines having at least one alkyl or alkenyl group of 40 to 400 carbon atoms in the molecule, polyamines having at least one alkyl or alkenyl group of 40 to 400 carbon atoms in the molecule, boron compounds of them, derivatives of them with carboxylic acid, phosphoric acid or the like, and others. In use, one or more kinds arbitrarily selected from these can be blended.

Examples of the antioxidant include ashless antioxidants such as phenolic or amine-base antioxidants and metal-base antioxidants such as copper or molybdenum-base antioxidants. Specific examples of the antioxidant include, for example, phenol-base ashless antioxidants such as 4,4'-methylenebis(2,6-di-tert-butylphenol) and 4,4'-bis(2,6-di-tert-butylphenol), amine-base ashless antioxidants such as phenyl-α-naphthylamine, alkylphenyl-α-naphthylamine and dialkyldiphenylamine, and others.

Examples of the corrosion inhibitor include, for example, benzotriazole compounds, tolyltriazole compounds, thiadiazole compounds, imidazole compound and others.

Examples of the antifoaming agent include, for example, silicone oils having kinematic viscosity at 25° C. of 1,000 to 100,000 $mm^2/s$, fluorosilicone oils, alkenylsuccinic acid derivatives, esters of a polyhydroxyaliphatic alcohol and a long-chain fatty acid, methyl salicylate, o-hydroxybenzyl alcohol and others.

Examples of the friction modifier include organic molybdenum compounds such a succinimide molybdenum complex (e.g. molybdenum dithiocarbamate, molybdenum dithiophosphate and the like) and an amine salt of an organic molybdic acid, and compounds having a linear alkyl group of 8 to 30 carbon atoms and a polar group that can be adsorbed on a metal in the molecule. Examples of the polar group include amines, polyamines, amides, amine compounds which simultaneously have these groups in the molecule, fatty acid esters, fatty acid amides, fatty acids, aliphatic alcohols, aliphatic ethers, urea compounds, hydrazide compounds, alkenyl succinimide esters, alcohols or diols, monoalkyl glycerin ester having both an ester and a hydroxyl group, and others. In addition, various compounds such as alkylamine alkoxy alcohols having both an amine group and a hydroxyl group in the molecule are also exemplified.

In the case where the lubricating oil composition contains one or more kinds selected from the group consisting of a pour point depressant, an anti-wear agent, a metal-base detergent dispersant, an ashless detergent dispersant, an antioxidant, a corrosion inhibitor, an antifoaming agent and a friction modifier, the content of each is preferably 0.01 mass % or more and 10 mass % or less, based on the total amount of the lubricating oil composition. In the case where the lubricating oil composition contains an antifoaming agent, the content of that is preferably 0.0001 mass % or more and 0.01 mass % or less. In the case where the lubricating oil composition is used as the base oil composition, the base oil composition may substantially consist of the viscosity index improver and a lubricating base oil, and in this case, the total content of the viscosity index improver and the lubricating base oil is preferably, for example, 98 mass % or more, more preferably 99 mass % or more and even more preferably 99.5 mass % or more, based on the total amount of the base oil composition The lubricating oil composition may further contain a viscosity index improver other than the polymer of the present invention, a rust inhibitor, a demulsifier, a metal deactivator and others, in addition to the above components.

The viscosity index improver other than the polymer of the present invention is specifically a non-dispersible or dispersible ester group-containing viscosity index improver, and examples of that include a non-dispersible or dispersible poly(meth)acrylate-base viscosity index improver, a non-dispersible or dispersible olefin-(meth)acrylate copolymer-base viscosity index improver, a styrene-maleic anhydride ester copolymer-base viscosity index improver, mixtures thereof, and others. Among them, a non-dispersible or dispersible poly(meth)acrylate-base viscosity index improver is preferable, and a non-dispersible or dispersible polymethacrylate viscosity index improver is more preferable. Other examples of that include non-dispersible or dispersible ethylene-α-olefin copolymers or hydrides thereof, polyisobutylene or hydrides thereof, styrene-diene hydrogenated copolymers, polyalkylstyrene and others.

Examples of the rust inhibitor include, for example, petroleum sulfonate, alkylbenzene sulfonate, dinonyl naphthalene sulfonate, alkenyl succinate ester, polyhydric alcohol ester and others.

Examples of the demulsifier include, for example, polyalkylene glycol nonionic surfactants such as polyoxyethylene alkyl ether, polyoxyethylene alkyl phenyl ether and polyoxyethylene alkyl naphthyl ether.

Examples of the metal deactivator include, for example, imidazoline, pyrimidine derivatives, alkylthiadiazoles, mercaptobenzothiazole, benzotriazole or derivatives thereof, 1,3,4-thiadiazole polysulfide, 1,3,4-thiadiazolyl-2,5-bisdialkyl dithiocarbamate, 2-(alkyldithio)benzimidazole, β-(o-carboxybenzylthio)propionenitrile and others.

This application claims priority to Japanese Patent Application No. 2014-189053, filed on Sep. 17, 2014, and Japanese Patent Application No. 2015-079392, filed on Apr. 8, 2015, and the entire contents of which are incorporated by reference herein.

EXAMPLES

The present invention will be hereinafter described more specifically by reference to Examples; however, the present invention is not limited to these Examples. In Examples and Comparative Examples, the terms "%" and "parts" respectively represent "mass %" and "part by mass", unless otherwise noted.

(1) Analysis Method (Weight-Average Molecular Weight and Number-Average Molecular Weight)

Measurement of the weight-average molecular weight and number-average molecular weight of a polymer was conducted by using the following system under the following conditions.

System: GPC system HLC-8220 manufactured by Tosoh Corporation

Measurement Side Column Configuration

Guard column: TSK guard column Super HZ-L manufactured by Tosoh Corporation

Separation column: TSKgel Super HZM-M 2 columns manufactured by Tosoh Corporation Reference Side Column Configuration Reference column: TSKgel Super H-RC manufactured by Tosoh Corporation Developing solvent: chloroform (available from Wako Pure Chemical Industries, special grade)

Flow rate of developing solvent: 0.6 mL/min

Standard sample: TSK standard polystyrene (PS-oligomer kit, manufactured by Tosoh Corporation)

Column temperature: 40° C.

(Branching Degree)

Measurement of the branching degree of a polymer was conducted by using the following system under the following conditions.

System: Viscotek TDA (light scattering/viscosity/refractive index detector) manufactured by Malvern Instruments Ltd was connected to GPC system HLC-8320 manufactured by Tosoh Corporation Measurement Side Column Configuration Guard column: TSKgel guard column $H_{XL}$-H manufactured by Tosoh Corporation Separation column: TSKgel $GMH_{XL}$ 2 columns manufactured by Tosoh Corporation Sample injection amount: 100 μL Sample concentration: 0.200 mass %

Developing solvent: THF (0.8892 g/mL)

Flow rate of developing solvent: 1.0 mL/min

Equipment calibration sample: TSK standard polystyrene F-10

The branching degree was quantified as follows. A branching degree reference polymer (prepared by the operation described below) and polymers of Examples or Comparative Examples were measured by the above system. Prior to the measurement, a polymer base oil solution of Example or Comparative Example was reprecipitated and dried twice. Reprecipitation was carried out by diluting the polymer with THF to 5 mass % and dropping it in 10 times amount of ethanol with stirring, and drying was carried out under vacuum at 80° C. for 8 hours. From the measurement results obtained by the above system, Mark-Houwink Plot was prepared using the analysis software OmniSEC (available from Malvern Instruments Ltd). Provided that a straight line, which was obtained by extrapolating a linear region of an absolute molecular weight Mw of 400,000 or less of the branching degree reference polymer having the same composition, corresponds to a straight chain structure, the branching degree of the polymers of Examples or Comparative Examples was calculated using a random polydisperse model. A detailed theory of this is described in the following documents and the description of which is incorporated herein by reference: "GPC School Handbook" (text for workshops), issued by Malvern Instruments Ltd; Hirohide Matsushita, "Polymer Chemistry II Physical Properties", published by Maruzen Co., Ltd. The branching degree was calculated for the range of the absolute molecular weight Mw of 400,000 to 1,300,000 obtained by the above system.

The branching degree reference polymer was prepared as follows. Into a reaction vessel equipped with a stirrer, a temperature sensor, a cooling tube, a nitrogen inlet tube and a dropping funnel, the same amount of monomers as in the corresponding Example or Comparative Example, 32.3 parts by mass of toluene, 0.05 parts by mass of an antioxidant (ADK STAB (registered trademark) 2112, manufactured by ADEKA Corporation) and 0.05 parts by mass of n-dodecyl mercaptan (DM) as a chain transfer agent were fed, and the content was raised to 105° C. while introducing nitrogen gas thereto. A solution prepared by mixing 0.0258 parts by mass of t-amylperoxyisononanoate (Luperox 570 (registered trademark), manufactured by Arkema Yoshitomi Ltd.) as a polymerization initiator and 0.46 parts by mass of toluene were added, and solution polymerization was proceeded while dropping a solution prepared by dissolving 0.0258 parts by mass of the polymerization initiator in 2.6 parts by mass of toluene over 1 hour, and then the polymerization was stopped by cooling. The obtained polymerization solution was diluted with THF to 5 mass % and dropping it in 10 times amount of ethanol with stirring. The obtained solid was dried at 80° C. under vacuum for 8 hours to obtain the branching degree reference polymer.

(Base Oil Solubility)

A base oil solution containing a polymer in the concentration of 30 mass % was judged as A or B according to the following criteria.

A: the solution is transparent, that is visually completely dissolved at 25° C.

B: the solution is cloudy or a residue is visually observed at 25° C.

(Viscosity Index)

A polymer was diluted with a base oil (viscosity index: 130) so that the kinematic viscosity at 100° C. was 7.0 $mm^2/s$, and a viscosity index was measured according to the method of HS K 2283. In the case where the viscosity index was 230 or more, it was judged as A, in the case where the viscosity index was 210 or more and less than 230, it was judged as B, and in the case where the viscosity index was less than 210, it was judged as C.

(Shear Stability)

A polymer was diluted with a base oil (viscosity index: 130) so that the kinematic viscosity at 100° C. was 7.0 $mm^2/s$, and ultrasonic irradiation was applied under the following conditions.

Apparatus: UP400S manufactured by Hielscher Ultrasonics

Setting: Amplitude=70%, Cycle=1

Time: 5 minutes

Temperature: 100° C.

The kinematic viscosity at 100° C. of a base oil and before and after shearing was measured, and in the case where the value of the SSI was less than 25, it was judged as A, and in the case where the value of the SSI was 25 or more, it was judged as B, wherein the SSI is calculated from the following equation: SSI={1−(kinematic viscosity after shearing−kinematic viscosity of a base oil)/(kinematic viscosity before shearing−kinematic viscosity of a base oil)}×100.

(SP Value)

The SP value (solubility parameter) of a polymer was calculated using the Materials Studio (registered trademark) Ver. 6.1 MS-Synthia module available from Accelrys AG. First, a monomer structure was created and a repeated structure was defined. Using the defined monomer structure, polymer physical properties such as solubility parameter were calculated with the MS-Synthia module. The MS-Synthia module is a software for calculating physical properties of macromolecules by using Quantitative Structure Property Relationships (QSPR), and by using a bond index obtained from a graph theory, physical properties of macromolecules can be calculated. Detailed theory is described in the following document, and the description of which is incorporated herein by reference: Jozef Bicerano, "Prediction of Polymer Properties, 3rd Edition", published by Marcel Dekker. For this time, among the SP values (solubility parameters) of the Fedors method improved by Bicerano, that is able be calculated by the MS-Synthia, and the van Krevelen method, the value of the Fedors method was employed.

(2) Preparation Example of Polymer Base Oil Solution

Example 1

Into a reaction vessel equipped with a stirrer, a temperature sensor, a cooling tube, a nitrogen inlet tube and a dropping funnel, 20 parts by mass of methyl methacrylate (MMA), 70 parts by mass of stearyl methacrylate (StMA), 10 parts by mass of N-phenylmaleimide (PMI), 52.8 parts by mass of toluene, 0.05 parts by mass of an antioxidant (ADK STAB (registered trademark) 2112, manufactured by ADEKA Corporation), 0.40 parts by mass of acetic anhydride, 0.05 parts by mass of pentaerythritol tetrakis(mercaptoacetate) were fed, and the content was raised to 105° C. while introducing nitrogen gas thereto. A solution prepared by mixing 0.0258 parts by mass of t-amylperoxyisononanoate (Luperox (registered trademark) 570, manufactured by Arkema Yoshitomi Ltd.) as a polymerization initiator and 0.46 parts by mass of toluene were added, and solution polymerization was proceeded while dropping a solution prepared by dissolving 0.205 parts by mass of the polymerization initiator in 20.5 parts by mass of toluene over 4 hours, and further aging was carried out for 2 hours.

Subsequently, the cooling pipe was replaced by a distilling head connected to a cooling pipe and a distillate receiver, and 233 parts by mass of a base oil (viscosity index 130) was fed into the reaction vessel. After raising a bath temperature to 150° C., the pressure was gradually reduced using a vacuum pump to remove toluene. After 30 minutes from the internal temperature reached 142° C., pressure reduction was released and cooled to obtain a polymer base oil solution (polymer concentration: 30 mass %). The result is shown in Table 1.

Example 2

Into a reaction vessel equipped with a stirrer, a temperature sensor, a cooling tube, a nitrogen inlet tube and a dropping funnel, 35 parts by mass of MMA, 60 parts by mass of StMA, 5 parts by mass of PMI, 32.3 parts by mass of toluene, 0.05 parts by mass of an antioxidant (ADK STAB (registered trademark) 2112, manufactured by ADEKA Corporation), 0.40 parts by mass of acetic anhydride and 0.10 parts by mass of pentaerythritol tetrakis(mercaptoacetate) were fed, and the content was raised to 105° C. while introducing nitrogen gas thereto. A solution prepared by mixing 0.0258 parts by mass of t-amylperoxyisononanoate (Luperox (registered trademark) 570, manufactured by Arkema Yoshitomi Ltd.) as a polymerization initiator and 0.46 parts by mass of toluene was added, and solution polymerization was proceeded while dropping a solution prepared by dissolving 0.205 parts by mass of the polymerization initiator in 20.5 parts by mass of toluene over 4 hours, and further aging was carried out for 2 hours.

Subsequently, the cooling pipe was replaced by a distilling head connected to a cooling pipe and a distillate receiver, and 233 parts by mass of a base oil (viscosity index 130) was fed into the reaction vessel. After raising a bath temperature to 150° C., the pressure was gradually reduced using a vacuum pump to remove toluene. After 30 minutes from the internal temperature reached 142° C., pressure reduction was released and cooled to obtain a polymer base oil solution (polymer concentration: 30 mass %). The result is shown in Table 1.

Comparative Example 1

Into a reaction vessel equipped with a stirrer, a temperature sensor, a cooling tube, a nitrogen inlet tube and a dropping funnel, 40 parts by mass of MMA, 60 parts by mass of StMA, 0.05 parts by mass of an antioxidant (ADK STAB (registered trademark) 2112, manufactured by ADEKA Corporation), 0.40 parts by mass of acetic anhydride, 0.10 parts by mass of n-dodecyl mercaptan (DM) and 0.46 parts by mass of toluene were fed, and the content was raised to 105° C. while introducing nitrogen gas thereto. Subsequently, a solution prepared by dissolving 0.205 parts by mass of t-amylperoxyisononanoate (Luperox (registered trademark) 570, manufactured by Arkema Yoshitomi Ltd.) in 10.5 parts by mass of toluene was added dropwise over 4 hours, whereby solution polymerization was proceeded. After thirty minutes from completion of the dropwise addition, 13.5 parts by mass of toluene was added, and further aging was carried out for 2.5 hours.

Subsequently, the cooling pipe was replaced by a distilling head connected to a cooling pipe and a distillate receiver, and 233 parts by mass of a base oil (viscosity index 130) was fed into the reaction vessel. After raising a bath temperature to 150° C., the pressure was gradually reduced using a vacuum pump to remove toluene. After 30 minutes from the internal temperature reached 142° C., pressure reduction was released and cooled to obtain a polymer base oil solution (polymer concentration: 30 mass %). The result is shown in Table 1.

Example 3

A polymer base oil solution (polymer concentration: 30 mass %) was obtained in the same manner as in Example 1, except that 70 parts by mass of StMA was replaced by 30 parts by mass of StMA and 40 parts by mass of lauryl methacrylate (LMA). The result is shown in Table 1.

Example 4

A polymer base oil solution (polymer concentration: 30 mass %) was obtained in the same manner as in Example 2, except that 35 parts by mass of MMA was replaced by 20 parts by mass of MMA, 60 parts by mass of StMA was replaced by 30 parts by mass of StMA and 40 parts by mass of LMA, and 5 parts by mass of PMI was replaced by 10 parts by mass of PMI. The result is shown in Table 1.

Example 5

A polymer base oil solution (polymer concentration: 30 mass %) was obtained in the same manner as in Example 3, except that 0.05 parts by mass of pentaerythritol tetrakis (mercaptoacetate) was replaced by 0.06 parts by mass of hexakis(3-mercaptopropionic acid) dipentaerythritol. The result is shown in Table 1.

Comparative Example 2

Into a reaction vessel equipped with a stirrer, a temperature sensor, a cooling tube, a nitrogen inlet tube and a dropping funnel, 20 parts by mass of MMA, 30 parts by mass of StMA, 10 parts by mass of PMI, 40 parts by mass of LMA, 32.3 parts by mass of toluene, 0.05 parts by mass of an antioxidant (ADK STAB (registered trademark) 2112, manufactured by ADEKA Corporation), 0.40 parts by mass of acetic anhydride and 0.05 parts by mass of DM were fed, and the content was raised to 105° C. while introducing nitrogen gas thereto. A solution prepared by mixing 0.0258 parts by mass of t-amylperoxyisononanoate (Luperox (registered trademark) 570, manufactured by Arkema Yoshitomi Ltd.) as a polymerization initiator and 0.46 parts by mass of toluene was added, and solution polymerization was proceeded while dropping a solution prepared by dissolving 0.103 parts by mass of the polymerization initiator in 10.3 parts by mass of toluene over 4 hours, and further aging was carried out for 2 hours.

Subsequently, the cooling pipe was replaced by a distilling head connected to a cooling pipe and a distillate receiver, and 233 parts by mass of a base oil (viscosity index 130) was fed into the reaction vessel. After raising a bath temperature to 150° C., the pressure was gradually reduced using a vacuum pump to remove toluene. After 30 minutes from the internal temperature reached 142° C., pressure reduction was released and cooled to obtain a polymer base oil solution (polymer concentration: 30 mass %). The result is shown in Table 1.

Example 6

Into a reaction vessel equipped with a stirrer, a temperature sensor, a cooling tube, a nitrogen inlet tube and a dropping funnel, 20 parts by mass of MMA, 30 parts by mass of StMA, 10 parts by mass of PMI, 40 parts by mass of LMA, 60.8 parts by mass of toluene, 0.05 parts by mass of an antioxidant (ADK STAB (registered trademark) 2112, manufactured by ADEKA Corporation), 0.40 parts by mass of acetic anhydride and 0.05 part by mass of pentaerythritol tetrakis(mercaptoacetate) were fed, and the content was raised to 105° C. while introducing nitrogen gas thereto. A solution prepared by mixing 0.0258 parts by mass of t-amylperoxyisononanoate (Luperox (registered trademark) 570, manufactured by Arkema Yoshitomi Ltd.) as a polymerization initiator and 0.46 parts by mass of toluene was added, and solution polymerization was proceeded while dropping a solution prepared by dissolving 0.103 parts by mass of the polymerization initiator in 10.3 parts by mass of toluene over 4 hours, and further aging was carried out for 4 hours.

Subsequently, the cooling pipe was replaced by a distilling head connected to a cooling pipe and a distillate receiver, and 233 parts by mass of a base oil (viscosity index 130) was fed into the reaction vessel. After raising a bath temperature to 150° C., the pressure was gradually reduced using a vacuum pump to remove toluene. After 30 minutes from the internal temperature reached 142° C., pressure reduction was released and cooled to obtain a polymer base oil solution (polymer concentration: 30 mass %). The result is shown in Table 1.

TABLE 1

| | Ex. 1 | Ex. 2 | Comp. Ex. 1 | Ex. 3 | Ex. 4 | Ex. 5 | Comp. Ex. 2 | Ex. 6 |
|---|---|---|---|---|---|---|---|---|
| (a) MMA | 20 parts | 35 parts | 40 parts | 20 parts | 20 parts | 20 parts | 20 parts | 20 parts |
| (b) StMA | 70 parts | 60 parts | 60 parts | 30 parts | 30 parts | 30 parts | 30 parts | 30 parts |
| (b) LMA | 0 parts | 0 parts | 0 parts | 40 parts | 40 parts | 40 parts | 40 parts | 40 parts |
| (c) PMI | 10 parts | 5 parts | 0 parts | 10 parts | 10 parts | 10 parts | 10 parts | 10 parts |
| Multifunctional mercaptan | tetra-functional 0.05 parts | tetra-functional 0.10 parts | (mono-functional) 0.10 parts | tetra-functional 0.05 parts | tetra-functional 0.10 parts | hexa-functional 0.06 parts | (mono-functional) 0.05 parts | tetra-functional 0.05 parts |
| SP value/(cal/cm$^3$)$^{1/2}$ | 9.31 | 9.32 | 9.22 | 9.36 | 9.36 | 9.36 | 9.36 | 9.36 |
| Mw/10$^4$ | 39.5 | 41.3 | 43.0 | 41.2 | 40.2 | 37.8 | 42.9 | 39.5 |
| Mn/10$^4$ | 11.6 | 13.8 | 15.4 | 10.8 | 10.4 | 10.6 | 12.4 | 13.2 |
| Mw/Mn | 3.4 | 3.0 | 2.8 | 3.8 | 3.9 | 3.6 | 3.4 | 3.0 |
| Branching degree | 1.9 | 1.5 | 0.4 | 2.4 | 2.9 | 1.7 | 0.7 | 1.5 |
| Base oil solubility | A | A | A | A | A | A | A | A |
| Viscosity index | 240 A | 234 A | 246 A | 241 A | 240 A | 239 A | 238 A | 239 A |
| Shear stability (SSI) | 21.5 A | 22.4 A | 28.5 B | 20.4 A | 19.1 A | 18.4 A | 25.3 B | 16.8 A |

By using a polymer obtained by polymerizing monomer components in the presence of tri- or higher functional mercaptan, a viscosity index improver which has high molecular weight and yet high shear stability without sacrificing base oil solubility was obtained.

INDUSTRIAL APPLICABILITY

The lubricating oil composition which contains the viscosity index improver comprising the polymer of the present invention is able to improve shear stability without sacrificing base oil solubility as compared with conventional lubricating oil compositions and the viscosity index thereof is similarly high, and hence, it can meet future fuel saving and long life requirements of automobiles and can be suitably used for a driving lubricating oil, a hydraulic oil and an engine oil.

The invention claimed is:

1. A viscosity index improver comprising a polymer obtained by polymerizing a maleimide monomer (a) represented by the following formula (1), that is referred to as a "component (a)":

(1)

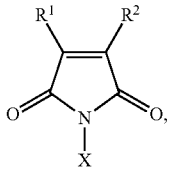

wherein $R^1$ and $R^2$ independently represent a hydrogen atom or an alkyl group, and X represents a hydrogen atom, a linear, cyclic or branched alkyl group, which optionally has an aromatic ring, or an aryl group; an alkyl (meth)acrylate (b) having an aliphatic hydrocarbon group of 6 to 40 carbon atoms, that is referred to as a "component (b)"; and an alkyl (meth)acrylate (c) having an aliphatic hydrocarbon group of 1 to 5 carbon atoms, that is referred to as a "component (c)"; as essential components of a monomer component, in the presence of a tri- or higher functional mercaptan and/or a tri- or higher functional initiator-;

wherein the polymer has a ring structure derived from the component (a) in a main chain, wherein the ring structure is represented by the following formula (4):

(4)

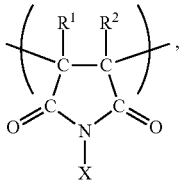

a content of the unit derived from the component (a) is 5 parts by mass or more and 30 parts by mass or less, relative to 100 parts by mass of the polymer, a content of the unit derived from the component (b) is 50 parts by mass or more and less than 95 parts by mass, relative to 100 parts by mass of the polymer, and a content of the unit derived from the component (c) is 2 parts by mass or more and less than 40 parts by mass, relative to 100 parts by mass of the polymer, and the polymer satisfies the following (1) to (3):

(1) weight-average molecular weight (Mw) of 200,000 or more and 600,000 or less;

(2) number-average molecular weight (Mn) of 90,000 or more;

(3) molecular weight distribution (Mw/Mn) of 4.0 or less.

2. The viscosity index improver according to claim 1, wherein the polymer satisfies the following (4):

(4) branching degree of 1.0 or more.

3. A lubricating oil composition comprising a lubricating base oil and the viscosity index improver according to claim 1, wherein a content of the viscosity index improver is 0.01 mass % or more and 70 mass % or less.

4. A viscosity index improver comprising a polymer having a branch unit derived from a tri- or higher functional mercaptan and/or a branch unit derived from a tri- or higher functional initiator, a unit having a ring structure in a main chain of the polymer, wherein the ring structure is represented by the following formula (4):

(4)

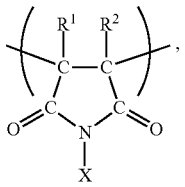

wherein $R^1$ and $R^2$ independently represent a hydrogen atom or an alkyl group, and X represents a hydrogen atom, a linear, cyclic or branched alkyl group, which optionally has an aromatic ring, or an aryl group, a unit derived from an alkyl (meth)acrylate having an aliphatic hydrocarbon group of 6 to 40 carbon atoms, and a unit derived from an alkyl (meth)acrylate having an aliphatic hydrocarbon group of 1 to 5 carbon atoms, wherein a content of the unit represented by the formula (4) is 5 parts by mass or more and 30 parts by mass or less, relative to 100 parts by mass of the polymer, a content of the unit derived from an alkyl (meth)acrylate having an aliphatic hydrocarbon group of 6 to 40 carbon atoms is 50 parts by mass or more and less than 95 parts by mass, relative to 100 parts by mass of the polymer, and a content of the unit derived from an alkyl (meth) acrylate having an aliphatic hydrocarbon group of 1 to 5 carbon atoms is 2 parts by mass or more and less than 40 parts by mass, relative to 100 parts by mass of the polymer, and the polymer satisfies the following (1) to (3):

(1) weight-average molecular weight (Mw) of 200,000 or more and 600,000 or less;

(2) number-average molecular weight (Mn) of 90,000 or more;

(3) molecular weight distribution (Mw/Mn) of 4.0 or less.

5. The viscosity index improver according to claim 4, wherein the polymer satisfies the following (4):

(4) branching degree of 1.0 or more.

6. A lubricating oil composition comprising a lubricating base oil and the viscosity index improver according to claim 4, wherein a content of the viscosity index improver is 0.01 mass % or more and 70 mass % or less.

7. A method for producing a viscosity index improver comprising the step of polymerizing a maleimide monomer (a) represented by the following formula (1), that is referred to as a component (a):

(1)

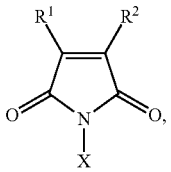

wherein $R^1$ and $R^2$ independently represent a hydrogen atom or an alkyl group, and X represents a hydrogen atom, a linear, cyclic or branched alkyl group, which optionally has an aromatic ring, or an aryl group; an alkyl (meth)acrylate (b) having an aliphatic hydrocarbon group of 6 to 40 carbon atoms, that is referred to as a "component (b)"; and an alkyl (meth)acrylate (c) having an aliphatic hydrocarbon group of 1 to 5 carbon atoms, that is referred to as a "component (c)"; as essential components of a monomer component, in the presence of a tri- or higher functional mercaptan and/or a tri- or higher functional initiator, thereby obtaining a polymer having a ring structure derived from the component (a) in a main chain, wherein the ring structure is represented by the following formula (4):

(4)

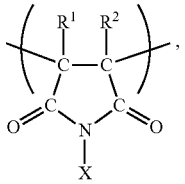

a used amount of the component (a) is 5 parts by mass or more and 30 parts by mass or less, relative to 100 parts by mass of the monomer components, a used amount of the component (b) is 50 parts by mass or more and less than 95 parts by mass, relative to 100 parts by mass of the monomer components, and a used amount of the component (c) is 2 parts by mass or more and less than 40 parts by mass, relative to 100 parts by mass of the monomer components.

* * * * *